US007789134B2

(12) United States Patent
Harris

(10) Patent No.: US 7,789,134 B2
(45) Date of Patent: Sep. 7, 2010

(54) DOWNHOLE/OPENHOLE ANCHOR

(75) Inventor: Robert D. Harris, Big Lake, AK (US)

(73) Assignee: Baker Hughes Incorporated, Houston, TX (US)

( * ) Notice: Subject to any disclaimer, the term of this patent is extended or adjusted under 35 U.S.C. 154(b) by 187 days.

(21) Appl. No.: 11/345,214

(22) Filed: Feb. 1, 2006

(65) Prior Publication Data

US 2007/0175629 A1 Aug. 2, 2007

(51) Int. Cl.
*E21B 23/03* (2006.01)

(52) U.S. Cl. ..... 166/117.6; 166/217

(58) Field of Classification Search ..... 166/217, 166/117.6, 255.3, 382; 299/31
See application file for complete search history.

(56) References Cited

U.S. PATENT DOCUMENTS 3,460,617 A * 8/1969 Brown et al. ..... 166/124
4,098,335 A * 7/1978 Goad ..... 166/120
4,527,837 A * 7/1985 Snyder ..... 299/31
5,467,819 A * 11/1995 Braddick ..... 166/117.6
5,791,417 A * 8/1998 Haugen et al. ..... 166/298
5,836,387 A * 11/1998 Carter ..... 166/217
6,167,961 B1 * 1/2001 Pollard et al. ..... 166/117.6
6,360,821 B1 * 3/2002 Braddick ..... 166/117.6
6,761,217 B1 * 7/2004 McGarian ..... 166/255.3
6,968,896 B2 * 11/2005 Coon ..... 166/117.6
2001/0047872 A1 * 12/2001 Roberts et al. ..... 166/387
2002/0170713 A1 * 11/2002 Haugen et al. ..... 166/298
2005/0150692 A1 * 7/2005 Ballantyne et al. ..... 175/61

* cited by examiner

*Primary Examiner*—Daniel P Stephenson
(74) *Attorney, Agent, or Firm*—Steve Rosenblatt

(57) ABSTRACT

A whipstock/billet anchor can be set in open hole such that one or more slips initially shift laterally near the lower end or below the whipstock/billet while the upper end reacts and gets pushed against the wellbore. Then with the top of the whipstock/billet against the wellbore another slip gets a bite to secure the whipstock/billet in a manner where the wellbore gives it some support near its upper end as a drill bit engages the whipstock/billet to make a lateral. Open and cased hole application is contemplated. The anchor also allows running in and supporting a tubular string below and a tool above with the further option of cocking the tool for better support before securing it.

20 Claims, 3 Drawing Sheets

DOWNHOLE/OPENHOLE ANCHOR

FIELD OF THE INVENTION

The field of this invention is downhole anchor and more particularly anchors for supporting a whipstock/billet or aluminum kickoff plug and more particularly in open hole environments although cased hole applications are contemplated.

BACKGROUND OF THE INVENTION

Laterals are kicked off in an open hole well with a whipstock/billet/billet supported on an anchor. The whipstock/billet slide has an inclined face that can direct the gauged hole bit to start a lateral in the proper orientation, the aluminum billet is round with a pocket notched at the top to help start bi-center bits. Known orientation tools are used to insure the proper positioning of the whipstock/billet/billet face. The whipstock/billet, after being properly oriented is normally secured by an anchor assembly, open hole anchors in the past did not have a adjustable fulcrum point, this tool not only anchors the whipstock/billet/billet but also forces the top of the whipstock/billet/billet to the formation wall holding the whipstock/billet/billet secure in the desired direction. Typically the slips that are part of the anchor assembly are actuated to move radially outward. The slips are normally around the periphery of the anchor body and when actuated secure putting the anchor and attached whipstock/billet/billet in the center of a cylindrical wellbore.

In open hole applications the slips of the anchor bite into the formation. When anchors in the past were actuated, for example in open hole, the upper end of the whipstock/billet/billet was centered in the surrounding wellbore. When the drill bit was advanced to drill the lateral its interaction with the top of the whipstock/billet/billet that was unsupported by the surrounding well bore can cause vibration on the anchor slips causing them lose the grip on formation. As a result the whipstock/billet/billet was without support and could slip down the well bore. At that point drilling had to stop a sidetrack has to be done above the whipstock/billet/billet process repeated, or the well was plugged back to a kickoff point with cement this adds additional time and incremental increase to the drilling cost. This proved to be troublesome in the past particularly in open hole applications.

FIGS. 1 and 2 illustrate the problem with the prior designs. FIG. 1 shows a whipstock/billet 10 without the running string that would normally deliver it and help set the anchor 12 that is below it. FIG. 1 illustrates a vertical bore 14 but the same result will occur in a deviated bore. An open hole 14 is illustrated as opposed to a cased hole. The anchor 12 has upper slips 16 and lower slips 18 that are disposed around the outer periphery and generally in a symmetrical manner. The gripper teeth 20 and 24 have opposed orientations to hold the whipstock/billet 10 in wellbore 14 against applied forces that may come in opposed directions. When the setting tool (not shown) is actuated to set the anchor 12 the slips 16 and 18 tend to center the whipstock/billet 10 in the wellbore 14 as indicated by the annular gap 26 shown in FIG. 2 representing the set position. One reason this occurs is that the slips 16 and 18 are close to each other and move out at the same rates. Those skilled in the art will appreciate that a passage 28 is used for actuation of anchor 12 and after actuation leaves a passage that can provide access to the wellbore below the whipstock/billet 10.

The problem with this design is that the whipstock/billet is a very long and slender structure that is subjected to complex loading when engaged by a rotating bit. When centered in a wellbore it has no lateral support and acts akin to a cantilevered beam subjected to torsion and lateral loads. As a result, grip failures have occurred in the past.

The present invention addresses the issue with a grip system with offset grippers that initially push in a given direction laterally below a whipstock/billet so as to cant or cock the opposite end of the whipstock/billet against the wellbore whereupon that position is then locked in by another set of slips spaced from the initial slip or slips vertically as well as circumferentially, in the preferred embodiment. Additionally, the anchor of the present invention can support a downhole tool above and a tubular string below and be actuated to support both while also allowing fluid communication through the tool, such as a whipstock/billet or a billet, to the tubular string below. These and other aspects of the invention will be readily appreciated by those skilled in the art from a review of the description of the preferred embodiment, the drawings and the claims which appear below.

SUMMARY OF THE INVENTION

A whipstock/billet anchor can be set in open hole such that one or more slips initially shift laterally near the lower end or below the whipstock/billet/billet while the upper end reacts and gets pushed against the wellbore. Then with the top of the whipstock/billet/billet against the wellbore another slip gets a bite to secure the whipstock/billet in a manner where the wellbore gives it full support at the upper end as a drill bit engages the whipstock/billet/billet to make a lateral. Open and cased hole application is contemplated. The anchor also allows running in and supporting a tubular string below and a tool above with the further sidetrack options.

DETAILED DESCRIPTION OF THE DRAWINGS

DETAILED DESCRIPTION OF THE PREFERRED EMBODIMENT

Figure 1:
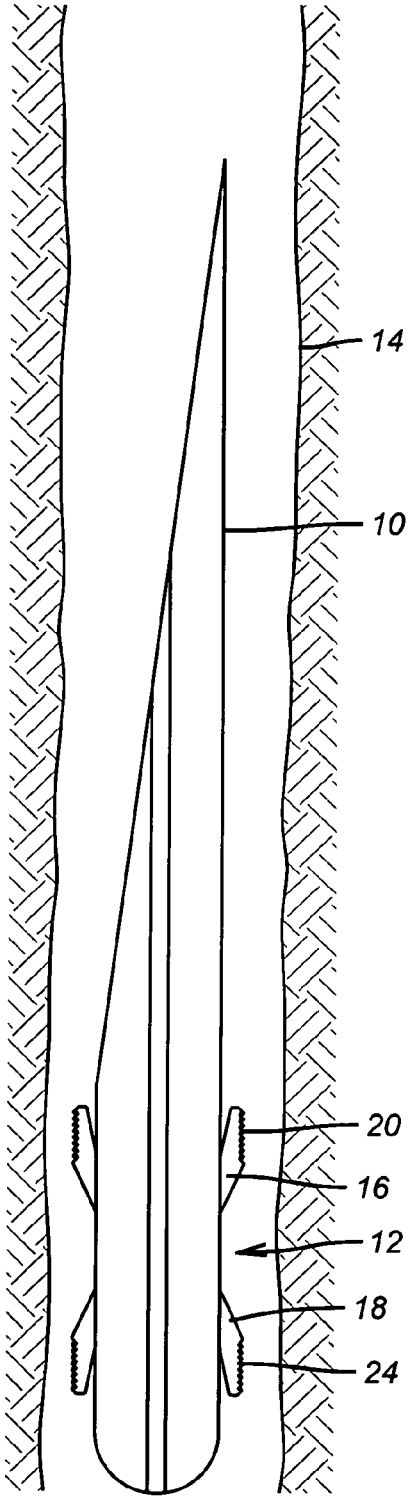
(PRIOR ART) FIG. 1
FIG. 1 is a schematic view of a prior art design anchor in the run in configuration.
Figure 2:
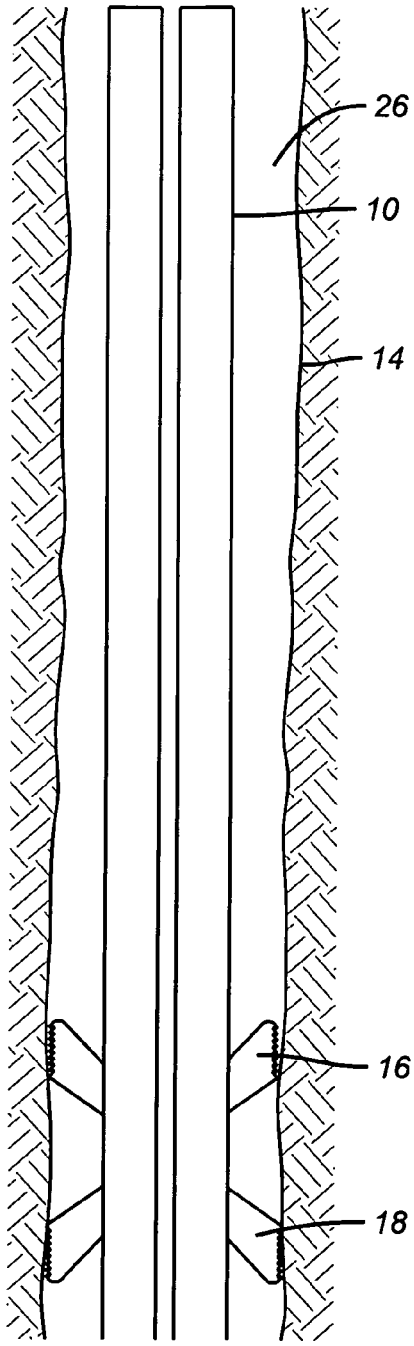
(PRIOR ART) FIG. 2
FIG. 2 is the anchor of FIG. 1 in the set position showing the whipstock/billet centered in a wellbore.
Figure 3:
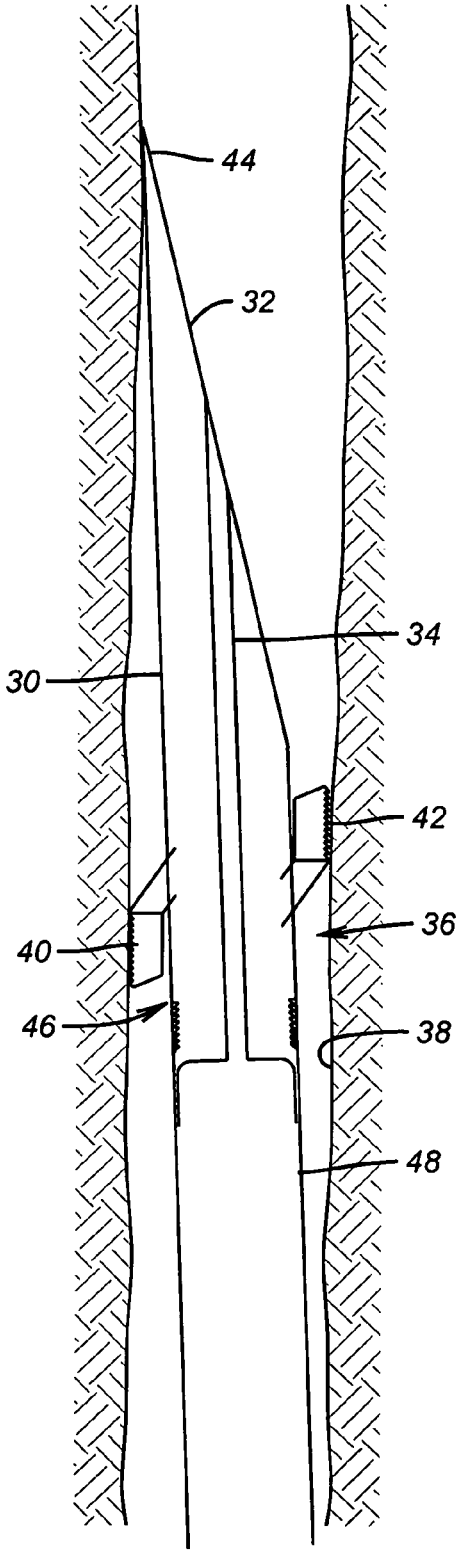
FIG. 3 shows one type of whipstock/billet with a set anchor of the present invention and support the whipstock/billet gets from the wellbore as well as a liner string supported below.

The overall assembly is best seen in FIG. 3. There a whipstock/billet 30 has a tapered face 32 and a through passage 34 through which a setting tool (not shown) is initially extending for setting the anchor 36 in borehole 38. Anchor 36 preferably has lower slip sets 40 of which only one is shown and at least one upper slip set 42. Preferably when there are two slip sets 40 and an upper slip set 42 the circumferential spacing among them is preferably about 120 degrees. This puts the lower slip sets 40 on one side of the anchor 36 with the upper slip set 42 on the other. In fact the angles of separation can vary with the idea being that the lower slips sets being on one half of the circumference and the upper slip sets on the other. The reason for this will be explained below.

Figure 4:
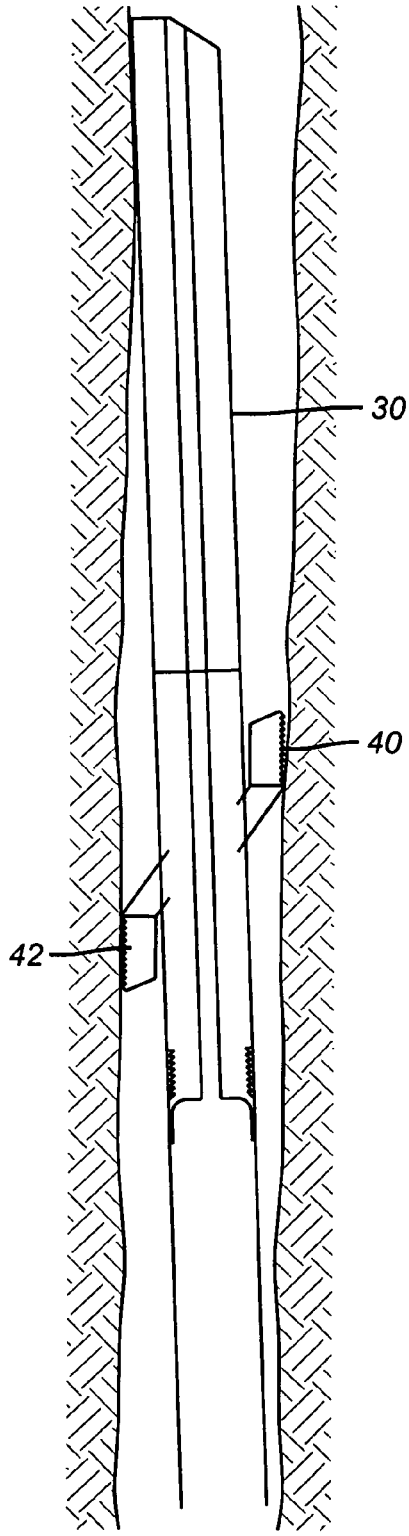
FIG. 4 is the same view of FIG. 3 with a billet type whipstock/billet.

Looking again at FIG. 3, showing the anchor 36 now set, it can be seen that the upper end 44 of the whipstock/billet 30 is pushed against the borehole 38. This happens when lower slip sets 40 push the lower end 46 of the whipstock/billet 30 to the right which in turn forces the upper end 44 of the whipstock/billet 30 toward the left. After that position is assumed, the upper slip set 42 still has room to move out radially and contact the borehole 38 to in effect lock the whipstock/billet 30 in the cocked position shown in FIGS. 3 and 4. The only difference between FIGS. 3 and 4 is the style of whipstock/billet that is used.

In another feature of the present invention, a liner 48 can be run in with the anchor 36 for support in the wellbore 38 at the same time the whipstock/billet 30 is set into position. As with all these applications the use of the present invention can be in open hole or cased hole.

Figure 5:
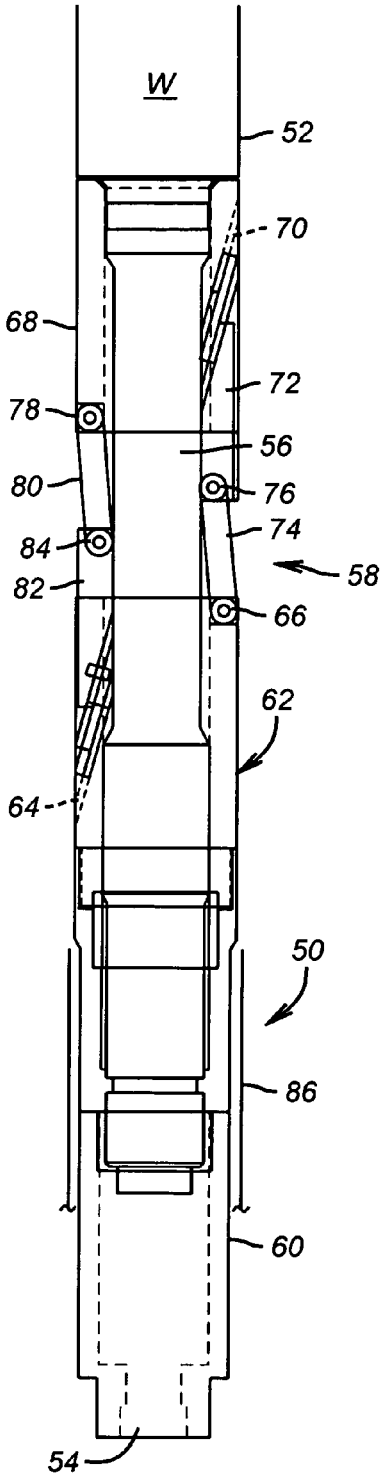
FIG. 5 is a section view of the slip assembly for the anchor shown in the run in position.
Figure 6:
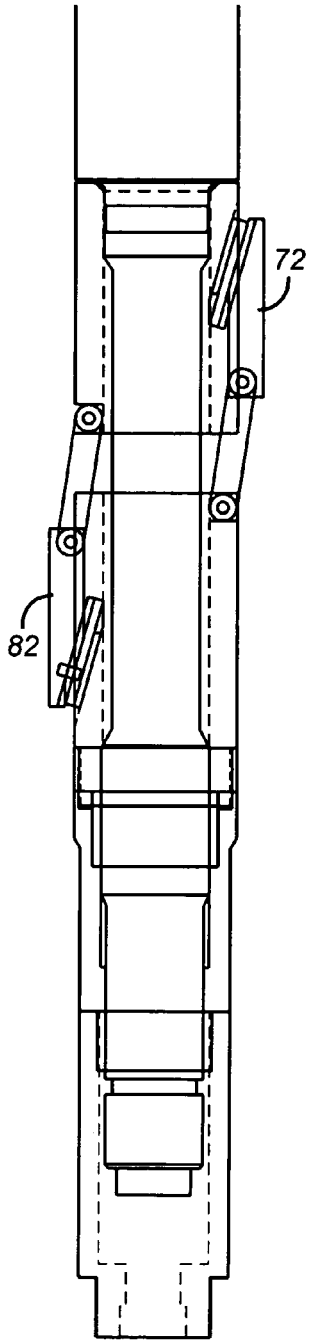
FIG. 6 is the view of FIG. 5 showing the slips starting to come out.
Figure 7:
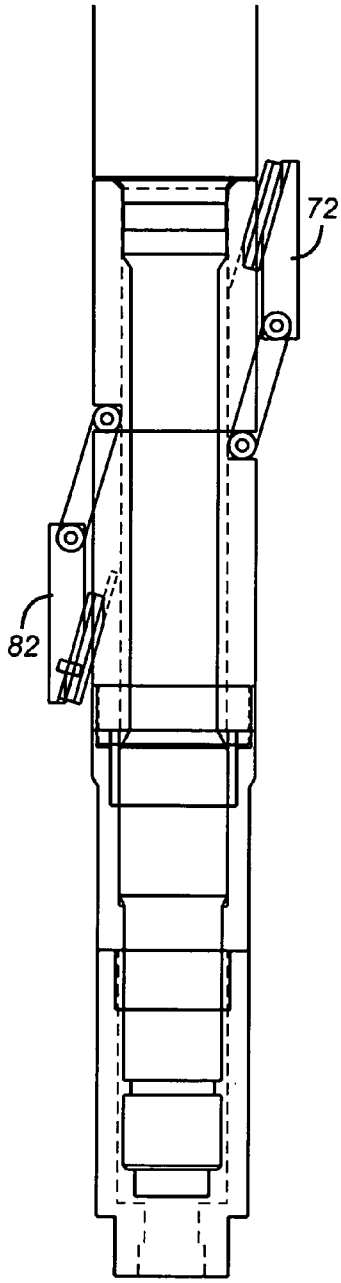
FIG. 7 shows the slips from FIG. 6 now in full extension.

Referring now to FIGS. 5-7 the workings of the anchor assembly 50 will be described. What is shown in FIGS. 5-7 is the lower end 52 of the whipstock/billet W. What is not shown is the known setting tool that holds down the top of the whipstock/billet while a rod also not shown extends through a lower end 54 of hollow mandrel 56. While the whipstock/billet W is held from coming uphole by the known setting tool the rod that extends to lower end 54 gets pulled up until a predetermined force is applied at which time a nut on the rod shears off and the setting tool is removed. This setting tool is omitted for drawing clarity and because its operation is well known to those skilled in the art. Instead what will be described is the operation of the anchor assembly 58 as the setting tool is actuated.

The setting tool (not shown) acts to push up on lower sub 60, which in turn pushes on body 62. Although only one inclined dovetail 64 is illustrated, there can be more than one and at least two that are circumferentially offset are preferred. Dovetail 64 is located axially below pivot point 66. In the preferred embodiment, the pivot point 66 is situated circumferentially opposite the dovetails 64 so that for example if there are two dovetails 64 and one pivot point 66 an angular spacing of about 120 degrees about the circumference put the two dovetails 64 on an opposite side from the pivot point 66. Why this matters will be explained below.

An upper body 68 is secured to the whipstock/billet W and does not move when the setting tool operates. Upper body 68 features a dovetail 70 on which rides up upper slip 72. Upper slip 72 is pinned to link 74 at pin 76. Link 74 is pinned at pivot point 66. Circumferentially on the other side from pivot point 66 is pivot point 78 which is axially higher. Link 80 is pinned to pivot point 78 and slip 82 is pinned at 84 to link 80.

The operation of the anchor assembly 50 will now be described. As the lower sub 60 is pushed up by the setting tool the dovetails 64 being on the same side circumferentially, when two or more are used, rise and preferentially move the slips 82 radially outwardly. While slip or slips 72 move radially out at the same time because dovetail 64 and pivot 66 move in tandem with body 62, the fact remains that slips 82 will reach the wellbore wall first because they are lower down the hole than slips 72 and depending on the wellbore orientation they present the heavy side of the assembly that due to gravity will seek the wellbore wall. It should be noted that even in a horizontal run the slips 82 can be oriented toward the high side of the lateral or the low side. When slips 82 are oriented toward the high side of a horizontal lateral they will still be lower and heavier and still cock the whipstock/billet W lower end 52 to the bottom of the horizontal run so that the whipstock/billet tip 44 shown in FIGS. 3 and 4 will go to the opposite or high side of the lateral at which time the slip 72 will get a bite opposite slip or slips 82 to lock in the cocked position of the whipstock/billet W. This in turn allows the whipstock/billet to get more support in the cased or open hole as its top 44 is firmly against the wellbore.

In general, the operation of the anchor 50 is to use axially offsetting slip assemblies disposed on opposed sides circumferentially. The lower slip or slips engage the wellbore first and cock the whipstock/billet or other downhole tool that is connected to the anchor 50. The cocking, in the case of a whipstock/billet W, puts the upper end hard against the wellbore for support once drilling or milling starts. To help retain that cocked position an upper slip or slips 72 gets a bite on the wellbore to hold the cocked position. With the whipstock/billet thus locked in a cocked position by slips at different elevations with different circumferential orientations, the whipstock/billet W is less likely to break loose at anchor 50 because it has wellbore support and is held in that position.

FIGS. 6 and 7 illustrate how the setting tool makes the slips 82 and 72 come out by pushing on lower sub 60.

Preferably there are more lower slips 82 than upper slips 72 with their distribution being such as to shift the center of gravity of the anchor 50 off of the longitudinal axis. This weight and position distribution of the slips assists in getting that cocking motion going and allows the slips 82 to in turn get the whipstock/billet top 44 cocked in an opposite direction for a better lock of the cocked position when slip 72 then gets a bite.

Those skilled in the art will appreciate that the present invention works differently than prior through tubing whipstock/billets that have a linkage mounted slip on one side circumferentially and push the whipstock/billet body on the lower end opposite the slip up against the casing after being passed through tubing. In these designs, the whipstock/billet body is simply shoved over by an extending slip. In the present invention the whipstock/billet body is indeed shoved over by a lower slip or slips but the cocked position is then secured by an upper slip or slips making the locked position of the whipstock/billet more secure under the load of a mill or drill.

Those skilled in the art will appreciate that whether a whipstock/billet that is meant to divert a bit or mill or a billet that is intended to be partially chewed up in diverting a bit, is used the present invention presents a better way to secure them in open or cased hole and further allows the running in and supporting of a liner string at the same time. The liner can be solid or perforated and the present invention allows an anchor to be set that supports the liner and has the additional flexibility to properly support a whipstock/billet or billet or any other downhole tool. In the case of a whipstock/billet or billet, the anchor wedges the tool against the borehole and locks in that position with offset slips that in the preferred embodiment are axially and circumferentially offset. The liner 86 can be attached to body 62, for example, as shown in FIG. 5.

While the invention has been described with a certain degree of particularity, it is manifest that many changes may be made in the details of construction and the arrangement of components without departing from the spirit and scope of this disclosure. It is understood that the invention is not limited to the exemplified embodiments set forth herein but is to be limited only by the scope of the attached claims, including the full range of equivalency to which each element thereof is entitled.

I claim:

1. An anchor to support a tool in a subterranean bore, comprising:

a unitary rigid body having a longitudinal axis and an upper and lower end;

at least one lower slip mounted closer to said lower end than at least one upper slip, said lower slip fully supported by said body to initially move with respect to said body to contact the bore to cock said body in the wellbore and said upper slip is positioned on said body to move with respect to said body to subsequently engage the bore to lock said cocked position of said body when the tool is in use in the subterranean bore.

2. The anchor of claim 1, wherein:

said lower slip is disposed circumferentially on a 180 degree segment on said body different from said upper slip.

3. The anchor of claim 2, wherein:

said lower slip comprises a plurality of slips.

4. The anchor of claim 1, wherein:

said upper and lower slips are mounted to respective linkages and said body comprises a fixed and a movable component whereupon relative movement between said components actuates said linkages to move said slips radially from said longitudinal axis.

5. The anchor of claim 1, wherein:

said slips are mounted circumferentially asymmetrically about said body.

6. The anchor of claim 1, wherein:

said at least one lower slip comprises a plurality of slips said plurality exceeding the number of said at least one upper slip.

7. The anchor of claim 1, wherein:

said slips are mounted to said body in a manner to offset the center of gravity from said longitudinal axis of said body.

8. An anchor to support a tool in a wellbore, comprising:

a unitary rigid body having a longitudinal axis and an upper and lower end;

at least one lower slip mounted closer to said lower end than at least one upper slip, said lower slip fully supported by said body to initially move with respect to said body to contact the wellbore to cock said body in the wellbore and said upper slip is positioned on said body to move with respect to said body to subsequently engage the wellbore to secure said cocked position of said body;

said body support a tubular string adjacent said lower end.

9. An anchor to support a tool in a wellbore, comprising:

a body having a longitudinal axis and an upper and lower end;

at least one lower slip mounted closer to said lower end than at least one upper slip, said lower slip positioned on said body to initially contact the wellbore to cock said body in the wellbore and said upper slip is positioned on said body to engage the wellbore to secure said cocked position of said body;

said upper and lower slips are mounted to respective linkages and said body comprises a fixed and a movable component whereupon relative movement between said components actuates said linkages to move said slips radially from said longitudinal axis;

said linkages comprise at least one pivoting link and said slips are respectively guided near an end on said body opposite from an opposite end where said pivoting link connects to said slip.

10. The anchor of claim 9, wherein:

said guiding is respectively accomplished by an inclined dovetail.

11. The anchor of claim 10, wherein:

said dovetail for said upper slip is mounted to said fixed component and said dovetail for said lower slip is mounted on said movable component.

12. The anchor of claim 11, wherein:

said link for said upper slip is mounted on said movable component and said link for said lower slip is mounted to said fixed component.

13. An anchor to support a tool in a wellbore, comprising:

a unitary rigid body having a longitudinal axis and an upper and lower end;

at least one lower slip mounted closer to said lower end than at least one upper slip, said lower slip fully supported by said body to initially move with respect to said body to contact the wellbore to cock said body in the wellbore and said upper slip is positioned on said body to move with respect to said body to subsequently engage the wellbore to secure said cocked position of said body;

said body supports a whipstock/billet or a billet for subsequent drilling of a lateral; and said cocking of said body forces an upper end of the whipstock/billet or billet against the wellbore.

14. An anchor to support a tool in a wellbore, comprising:

a body having a longitudinal axis and an upper and lower end;

at least one lower slip mounted closer to said lower end than at least one upper slip, said lower slip positioned on said body to initially contact the wellbore to cock said body in the wellbore and said upper slip is positioned on said body to engage the wellbore to secure said cocked position of said body;

said body supports a whipstock/billet or a billet for subsequent drilling of a lateral;

said cocking of said body forces an upper end of the whipstock/billet or billet against the wellbore;

said body further supports a tubular string;

said whipstock/billet or billet further comprises a passage therethrough for fluid communication to said tubular string.

15. An anchor for a wellbore, comprising:

a body having a first passage and supporting a plurality of axially offset slips so that when sequentially set against the wellbore allows a downhole tool to be cocked while also being supported therein;

a downhole tool having a second passage in flow communication with said first passage, said downhole tool remaining connected to said body after said slip is set;

a tubular string attached to said body on an opposite side from said downhole tool and defining an internal passage and adapted to pass fluids through said internal passage to said first passage and through said second passage in said downhole tool.

16. An anchor for a wellbore, comprising:

a body having a first passage and supporting at least one slip so that when set against the wellbore allows a downhole tool to be supported therein;

a downhole tool having a second passage in flow communication with said first passage, said downhole tool remaining connected to said body after said slip is set;

a tubular string attached to said body on an opposite side from said downhole tool and defining an internal passage and adapted to pass fluids through said internal passage to said first passage and through said second passage in said downhole tool;

said at least one slip comprises a plurality of slips with at least one lower slip located closer to a lower end of said body than another of said slips in a manner where extension of said slips cocks said body and secures it to the wellbore in a cocked position.

17. An anchor for a wellbore, comprising:

a body having a first passage and supporting at least one slip so that when set against the wellbore allows a downhole tool to be supported therein; and a tubular string attached to said body and defining an internal passage and adapted to pass fluids through said internal passage to said first passage;

said at least one slip comprises a plurality of slips with at least one lower slip located closer to a lower end of said body than another of said slips in a manner where extension of said slips cocks said body and secures it to the wellbore in a cocked position;

said downhole tool comprises a whipstock/billet or billet having an upper end that is brought into contact with the wellbore when said body is cocked by said slips.

18. The anchor of claim 17, wherein:

said at least one lower slip is located on an opposed circumferential segment of said body than another slip mounted higher.

19. The anchor of claim 18, wherein:

said at least one lower slip comprises a plurality of lower slips that outnumber said at least one slip mounted higher.

20. The anchor of claim 19, wherein:

said lower slips initially cock said body to allow said at least one slip mounted higher to then engage the wellbore to lock the cocked position of said body.

* * * * *